US008800632B2

(12) United States Patent
Cooper et al.

(10) Patent No.: US 8,800,632 B2
(45) Date of Patent: Aug. 12, 2014

(54) SMOKE OR FIRE BARRIER

(76) Inventors: Andrew Paul Cooper, Hampshire (GB); Derek Kearney, Little Hampton (GB)

( * ) Notice: Subject to any disclaimer, the term of this patent is extended or adjusted under 35 U.S.C. 154(b) by 0 days.

(21) Appl. No.: 13/375,845

(22) PCT Filed: Jun. 8, 2010

(86) PCT No.: PCT/GB2010/001112

§ 371 (c)(1),
(2), (4) Date: Feb. 6, 2012

(87) PCT Pub. No.: WO2010/142944

PCT Pub. Date: Dec. 16, 2010

(65) Prior Publication Data

US 2012/0125546 A1 May 24, 2012

(30) Foreign Application Priority Data

Jun. 8, 2009 (GB) ..... 0909837.7
Jun. 9, 2009 (GB) ..... 0909913.6
Jun. 9, 2009 (GB) ..... 0909914.4

(51) Int. Cl.
*E06B 9/08* (2006.01)

(52) U.S. Cl.
USPC ..... 160/120; 160/184; 160/242

(58) Field of Classification Search
USPC ..... 160/120, 242, 243, 293.1, 310
See application file for complete search history.

(56) References Cited

U.S. PATENT DOCUMENTS

| | | | | |
|---|---|---|---|---|
| 1,153,015 | A * | 9/1915 | Bauer | 160/300 |
| 1,595,234 | A * | 8/1926 | Kuyper | 160/23.1 |
| 2,581,433 | A * | 1/1952 | North et al. | 160/120 |
| 3,809,144 | A * | 5/1974 | Garufo | 160/184 |
| 4,237,956 | A * | 12/1980 | Sivin et al. | 160/120 |
| 4,384,606 | A * | 5/1983 | Johnston et al. | 160/332 |
| 7,059,377 | B2 * | 6/2006 | Nien et al. | 160/120 |
| 7,237,592 | B2 * | 7/2007 | Arnoux et al. | 160/310 |
| 8,025,088 | B2 * | 9/2011 | Kim | 160/120 |
| 2009/0173454 | A1 * | 7/2009 | Cheng | 160/120 |
| 2012/0125546 | A1 * | 5/2012 | Cooper et al. | 160/241 |
| 2013/0098564 | A1 * | 4/2013 | Jang | 160/120 |

FOREIGN PATENT DOCUMENTS

| | | |
|---|---|---|
| EP | 0572200 | 12/1993 |
| EP | 1749963 | 2/2007 |

* cited by examiner

*Primary Examiner* — Blair M. Johnson
(74) *Attorney, Agent, or Firm* — Jennifer Meredith, Esq.; Meredith & Keyhani, PLLC

(57) ABSTRACT

A twin roller smoke or fire barrier having: two parallel rollers and a curtain comprised of narrow curtain portions rolled on the rollers and arranged along the length of the rollers of alternate rollers with end margins overlapping opposite each other; the barrier including: a mechanism for varying separation of the rollers by at least the change in the overall diameter of one roller and its curtain portions between wound-up and unwound states, the mechanism including: movable supported roller or rollers; whereby in the unwound state of the curtain, the overlapping margins abut or at least are separated by a negligible amount at the rollers.

25 Claims, 10 Drawing Sheets

SMOKE OR FIRE BARRIER

This application is a national stage under 35 U.S.C. 371 of International Application No. PCT/GB2010/001112 filed Jun. 8, 2010 which claims priority to and the benefit of United Kingdom patent application number 0909837.7 filed Jun. 8, 2009, United Kingdom patent application number 0909914.4 filed Jun. 9, 2009, and United Kingdom patent application number 0909913.6 filed Jun. 9, 2009.

The present invention relates to a smoke or fire barrier.

Smoke and fire barriers are intended to contain either smoke, fire or smoke and fire. In certain applications, fire barriers are required. In others the fire barrier must also stop smoke. Whereas in others still, the lower temperature task of restricting smoke from flowing throughout a building or other construction is adequate. Insofar as heat and smoke rises it may not be necessary for a smoke barrier to extend from a ceiling all the way to the floor. For instance at an atrium, a smoke curtain dropping from the ceilings around the atrium can contain the smoke from rising up the atrium. However, where the barrier is a fire barrier, it must extend all the way to the floor.

Wide barriers, that is with curtains having considerable lateral extent, the curtains often cannot be deployed from a single, unsupported roller, because the roller does not have sufficient stiffness to support the weight of the curtain. Intermediate supports or bearings can be provided for this. However this is not always possible.

It is known to solve this problem, by providing the barrier multiple rollers which are positioned either side by side or one above the other or in an arrangement intermediate these. The curtain deploys from the rollers in narrow portions, which overlap, one from one roller and the next from the other. The degree of overlap is an extent determined to suit the application. The overlapped curtain portions can then be, but are not necessarily, conjoined by a device such as a bottom bar to provide stability. The overlapped portions create the necessary seal because the fire condition will create a positive pressure which presses the overlaps together. The greater the pressure the greater the seal.

Overlapping types of curtains have advantages and disadvantages. A disadvantage is that if the overlap is small, each portion can deflect and open under air pressure. If the curtains are not conjoined the portions can open up more easily permitting smoke leakage.

The rollers, can be provided as single rollers or aligned sections of roller. They can have intermediate bearings between the narrow curtain portions or at least some of them.

This can give rise to another set of problems, in particular that as the curtain is deployed the diameter at which the narrow portions drop from the roller decreases with less curtain material remaining wound on the rollers, the individual portions move away from each other, with the potential for gaps to develop through which fire and/or smoke can escape.

Normally, the rollers are each provided with an internal motor, which has a reaction shaft extending from one end of the roller. The reaction shaft is fixed with respect to the structure in the which the barrier having the roller is installed and whereby the motor can turn the roller. The motor acts via a high reduction gearbox to generate sufficient torque to lift its curtain, with the gearbox and motor fast within the roller.

Please note that as used herein:

"curtain" means a textile screen that extends down from a deployment mechanism; "barrier" means the apparatus including both the curtain and the deployment mechanism; "twin roller barrier" means a barrier in which the curtain is deployed by unwinding from two parallel rollers, narrow curtain portions arranged along the length of the rollers on alternate rollers with end margins overlapping opposite each other.

The object of the present invention is to provide an improved smoke or fire barrier of the twin roller type:

According to the invention there is provided a twin roller smoke or fire barrier including:

- a mechanism for varying separation of the rollers by at least the change in the overall diameter of one roller and its curtain portions between wound-up and unwound states, the mechanism including:
  - movable supports for at least one of the rollers, the supports supporting at least the ends of the supported roller or rollers whereby in the unwound state of the curtain, the overlapping end portions abut or at least are separated by a negligible amount at the rollers.

Whilst it can be envisaged that the supports include bearings for journalling the roller(s) on the movable supports, normally the rollers will include internal bearings with non-rotating shafts connectable to the supports extending from the rollers.

Either or both of the rollers can be movable in separation from the other.

In a simple form of the separation varying mechanism, the rollers are each suspended via support links from a common axis above and between them, the rollers being supported at the distal end of the links. Under their weight and that of the curtain, the rollers swing together against each other—or at least with the curtain margins swinging against each other.

In another simple form of the separation varying mechanism, the rollers are mounted in support blocks able to slide towards and apart from each other, the blocks being sprung loaded towards each other or mounted in inclined tracks so as to move together under gravity.

In one such embodiment, the mechanism includes a rack and a pinion. The pinion being attached to the motor reaction shaft and in mesh with a rack above it, whereby the motor's torque in lifting the curtain is reacted as a torque tending to move pinion and the roller away from the other roller.

In the preferred embodiment, a member in the separation varying mechanism is connected to the reaction shaft of a roller rotation motor and gearbox in a manner to cause reaction, the torque exerted by the motor to wind up the curtain, to operate the mechanism to increase separation of the rollers. Both rollers can be moved in this way or one only.

Insofar as driving the motor to wind the curtain down applies a reverse torque such as to move the rollers together, this could be relied upon. However, since the normal mode of operation is for gravity-fail-safe unwinding of the curtain, the rollers are preferably supported in such a manner that they swing together under gravity during unwinding. Alternatively, springs can be provided for this purpose.

It can be envisaged that the member to which the reaction shaft is connected could be one of the supports for the roller concerned. However in the preferred embodiments, the member is additional to the supports.

In one embodiment, the rollers are supported on depending links and reaction members are provided in an invert-V, the members being pivoted together at their common end and pivoted to the roller-journalling ends of the supports, with at least one of the reaction members being connected to the reaction shaft of one of the rollers. Whilst it can be envisaged that the supports and/or the invert-V members could be ganged together from end to end of the rollers, so that the reaction torque from a single motor could separate the rollers, in practice it is preferred for at least one of the rollers to be provided with (oppositely rotating) motors at both ends, whereby it is moved away from the other roller uniformly from end-to-end. To economise on motors and avoid the risk of the invert-V members passing over centre, one roller only is preferably allowed to move, with the other being restrained.

In accordance with a particularly preferred feature there is provided a twin roller smoke or fire barrier including:

a curtain stabiliser having a pair of members extending laterally of the curtain on either side thereof and means for deploying the curtain stabiliser from an upper position, generally level with a bottom edge of the curtain when rolled up, to a lower level intermediate the deployed height of the curtain, the arrangement being such that in the event of opening of portions of the curtain below the stabiliser, the curtain remains un-disturbed and smoke containing above the stabiliser.

The level to which the stabiliser will be deployed can be set in accordance with the smoke layer depth for the installation of the barrier.

The deployment means can comprise mechanical interconnection with one or both of the main rollers for the curtain. Although the curtain extends from end to end of the rollers, it is envisaged that a drive could be taken from between curtain portions, where a curtain portion is present on the opposite roller. Such arrangement may be possible at a roller end. Mechanical interconnection is also possible by providing tapes for supporting the curtain stabiliser wound on smaller or differing diameter lengths of the roller, whereby one roller revolution deploys the curtain down further that the stabiliser. In the preferred embodiment, the stabiliser is deployed via tapes wound on the same roller diameter as the curtain portions, but of limited length. When their full extent is unwound, continuing turning of the rollers to fully deploy the curtain results in the stabiliser being wound up again, to its use position.

Alternatively the deployment means can be an independent mechanism, operated in a gravity fail-safe manner as the main rollers. The rate of fall and of retrieval of the stabiliser can be arranged to be less than that of the curtain by suitable choice of the motors and their reduction gearboxes. Equally descent rate can be modified when using tapes on the main curtain rollers by providing differing diameters between the curtain portion sections of the rollers and the stabiliser tape sections. It is conceivable for the stabiliser to be fully retrieved prior to full retrieval of the curtain, to avoid the curtain lifting and possibly pulling through the stabiliser.

The deployed position of the stabiliser will normally be regulated by tapes, cords or the like with which it is retrieved.

Whilst normally the stabiliser will horizontal when deployed, it can be envisaged that one or other end could deploy further down to more closely control that side of the curtain, even to the extent of the stabiliser extend to the bottom of the deployed curtain at one side.

Nevertheless in a simple arrangement, it can be envisaged that the deployment of the stabiliser can be stopped by stops in guides for its ends; it can be deployed downwards on a bottom bar or the like of the curtain; and retrieved upwards by the bottom bar.

The stabiliser can be a pair of bars, loosely linked at either end by links passing from one side of the curtain to the other at its edges. Alternatively, it can be a pair of horizontal plates either loosely or rigidly interconnected, in the latter case by spacing members rigidly connected to the plates.

Alternatively to the bars or plates being linked or tied together, or indeed in addition thereto, they can be guided at their ends by guides extending down on either side of the fall of the curtain.

The bars or plates can abut the curtain directly, one or other abutting in accordance with pressure across the curtain moving it in one or other direction, the movement being in accordance with clearance to allow free vertical movement of the curtain with respect to the stabiliser on deployment.

Alternatively, abutting members can be provided, hinged or otherwise movably connected to the bars or plates with the abutting members normally resting against the curtain. Conveniently the abutting members extend up from their hinges. Abutting the members allows them to control the curtain portions more closely against crossing at their edges, but also allows bottom weights of the curtain to be drawn up between them.

To help understanding of the invention, specific embodiments thereof will now be described by way of example and with reference to the accompanying drawings, in which.

Figure 1:
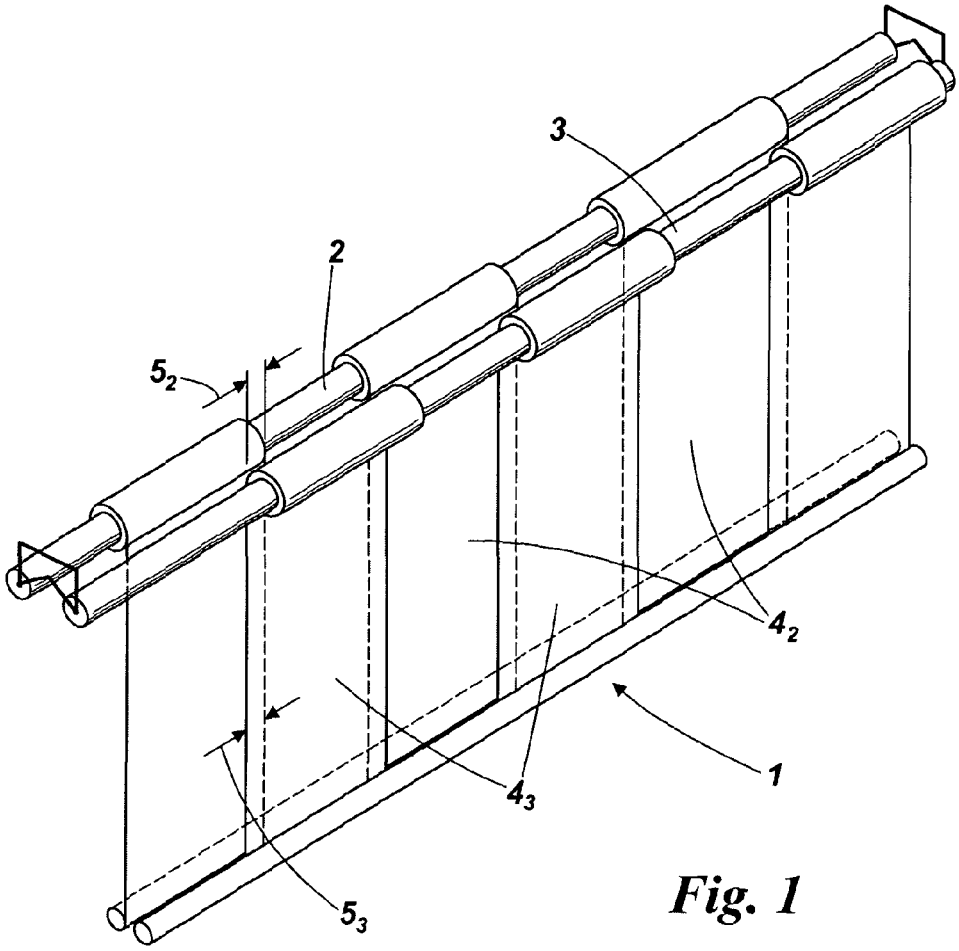
FIG. 1 is a perspective view of a barrier in accordance with the invention with its head box not shown.
Figure 3:
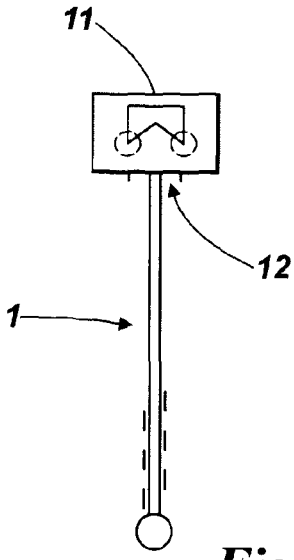
FIG. 3 is an end view with the headbox shown.

Referring to the drawings, a smoke curtain barrier 1 has two rollers 2,3. Each carries curtain portions $\mathbf{4}_2$ ,$\mathbf{4}_3$, which have overlapping end margins $\mathbf{5}_2$,$\mathbf{5}_3$, that is to say an end margin of a portion $\mathbf{4}_2$ overlaps with and abuts with or is close to an end margin of the next portion $\mathbf{4}_3$ along the length of the barrier. It should be noted that when the barrier is fully deployed the margins may not actually touch, but are close to each other and separated by an distance that is negligible in the context of smoke containment. Whilst such a distance will be known to the skilled reader, typically it is 5 mm.

Figure 2:
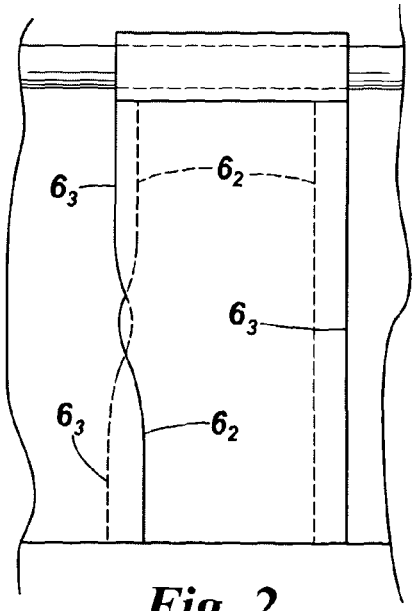
FIG. 2 is a scrap view of crossed over curtain portion edges.
Figure 4:
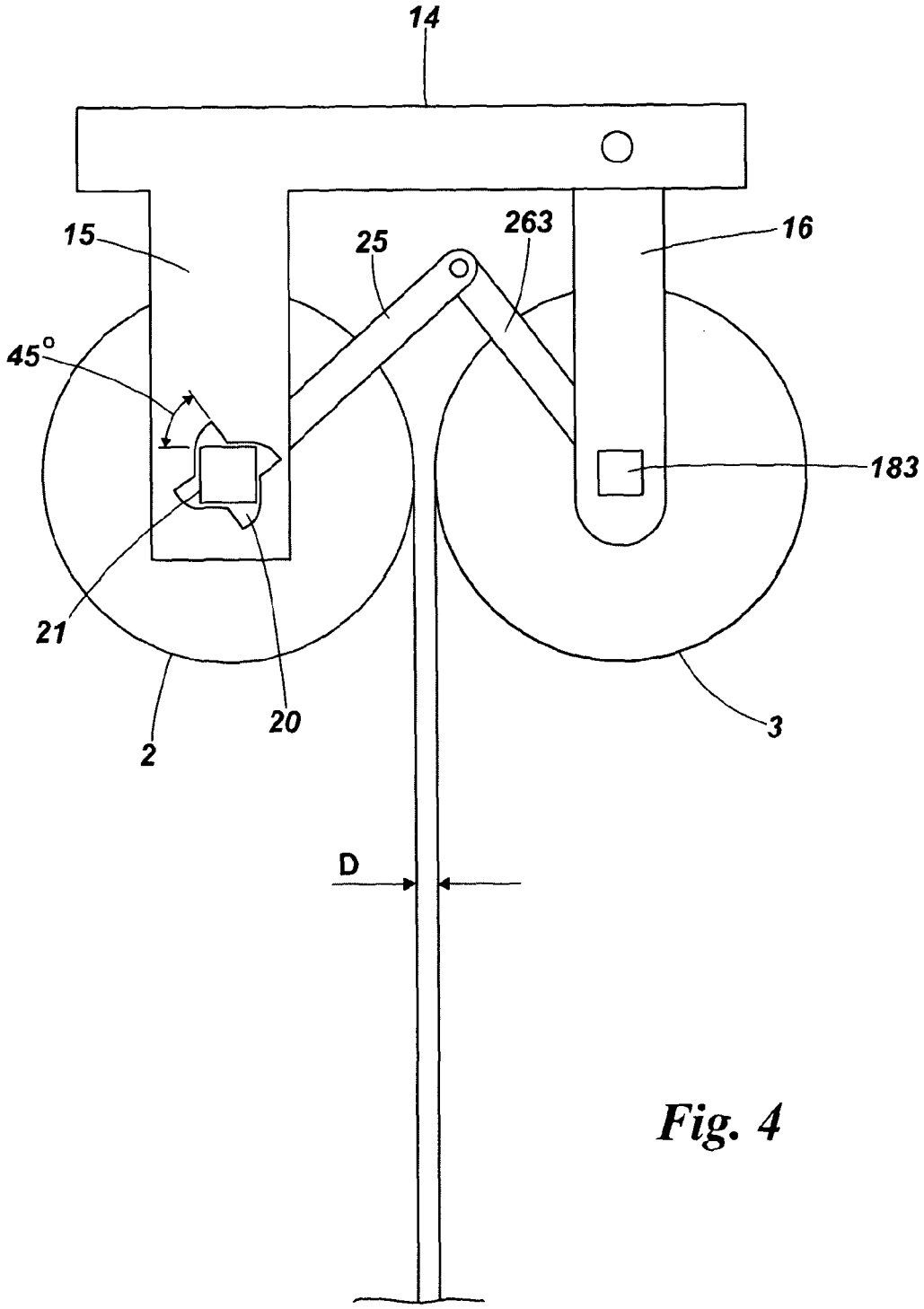
FIG. 4 is one end view of the rollers of the barrier, with the curtain deployed.

The arrangement of the curtain portions, as they hang down from the rollers on deployment, is such that they overlap at the margins throughout the height of the drop of the curtain. The extent of the overlap—again known to the skilled reader and typically 100 mm with the portions being 1000 mm wide—is such that under normal circumstances the barrier will form a barrier to smoke. The arrangement of curtain portions across the width of the curtain provides the ability for people trapped the wrong side of the barrier to pass through the barrier between adjacent portions, which can be readily parted from each other. Such use can result in curtain portions becoming displaced and abutting end edge $6_2$ to end edge $6_3$ as shown in FIG. 2. This can occur during routine deployment for servicing and inspection. On rewinding, the curtain can become folded, with the result that on subsequent deployment, the integrity of the curtain is compromised. This is part of the motivation for the invention providing for separation of the rollers on rewinding.

The rollers are mounted in a head box 11, which has an opening 12 through which the curtain deploys. The top of the box is provided at both ends with brackets 14, from which depend supports 15,16. The first 15 of these, one at one end and the other at the other for the roller 2, are integral with the supports brackets 14. At one, idling, end of the roller, there is a single support $15_1$, which has a square aperture 17 for the square end of the idling shaft 18 of the roller. A C-clip 19 retains the shaft in its aperture.

At a driving end of the roller, that is to say the end at which the roller has its internal motor and high reduction gearbox, the shaft would normally be held similarly in a square aperture for drive of the roller. In the arrangement of this embodiment, the driving shaft is allowed limited rotational freedom. Two supports $15_2$,$15_3$ are provided. An outer one $15_2$ of these is provided with an aperture 20 so shaped to allow the square 21 of the driving shaft 22 to rotate by 45°. An inner one $15_3$ has a plain bore 23 supporting a plain portion 24 of the shaft. Again a clip 19 retains the shaft in position. Inwards of the inner support $15_3$, a lever arm 25 is pinned to the shaft 22. When viewed from the end of the roller, the lever arm can turn 45° towards the other roller 3. It does this when the curtain is being wound up. The mechanics are explained more fully below. Suffice here to say that the shaft is free to do this with respect to the shaped aperture 20, which normally does not apply torque to the square of the shaft 22. A further lever arm 26 is pinned to the idling shaft 18. It exerts no torque and will be referred to as strut 26.

The other roller 3 is supported on two swinging supports 16, which are pivotally connected at their upper ends to the brackets 14. The idling and drive shafts 183, 223 are free to rotate in the lower ends of the supports 16. In other words, there is no rotational attachment between the shafts and the supports. On the other hand, the driving shaft 223 carries a lever arm 253 and the idler shaft 183 carries a lever arm 263. The distal ends of the lever arms, struts 25 & 263 and 26 and 253 are pivotally connected. It should be noted that the rollers 2,3 are symmetrical to the extent that their motors are at opposite ends and when viewed from respective ends, each is driven anti-clockwise for winding up of their curtain portions and by the same token, their curtain portions apply clockwise torque to them when they are being wound up. The non-driven ends of the rollers have anti-clockwise torque applied to them by their curtain portions.

Figure 5:
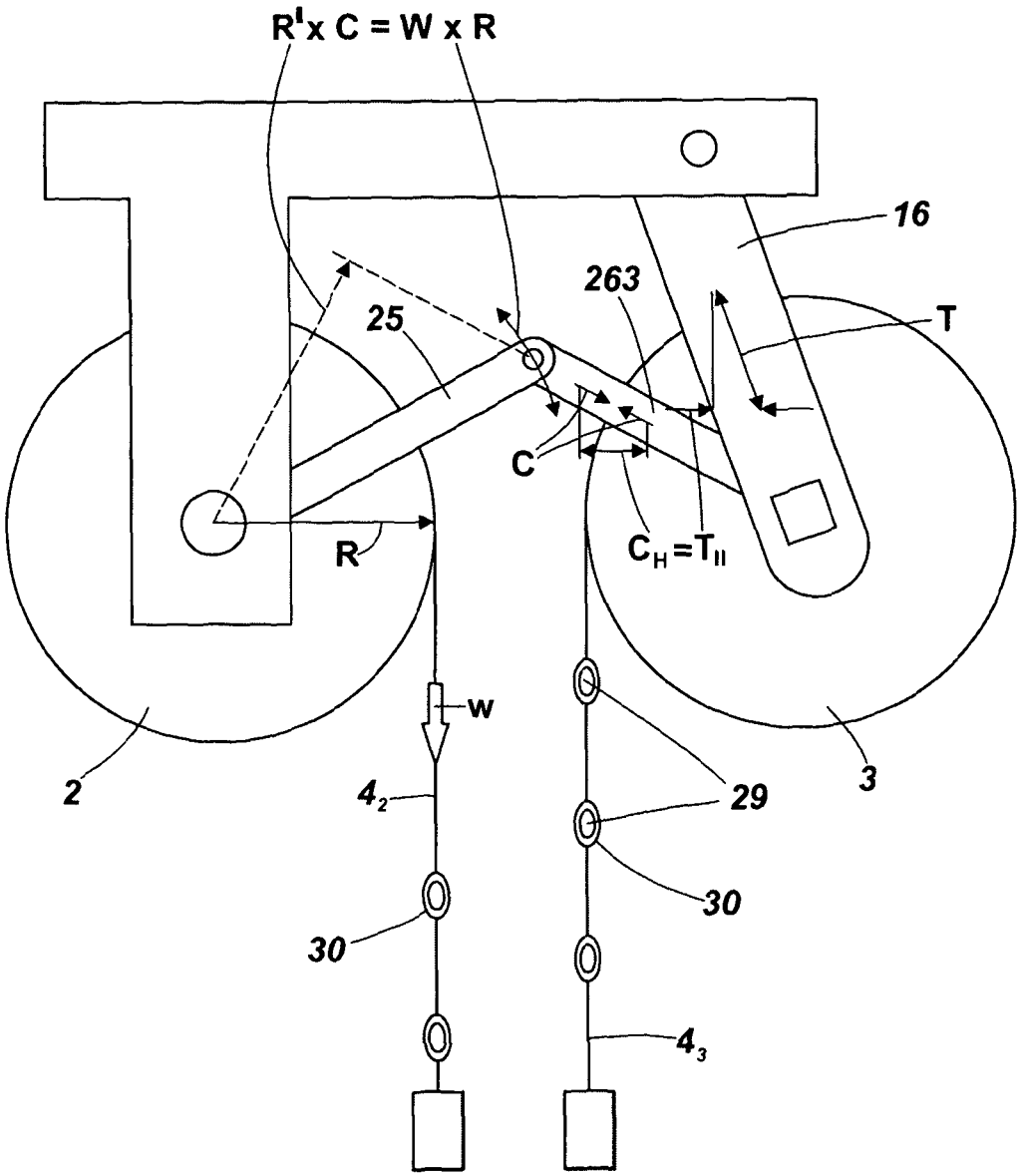
FIG. 5 is the same end view with the barrier mostly wound up.
Figure 6:
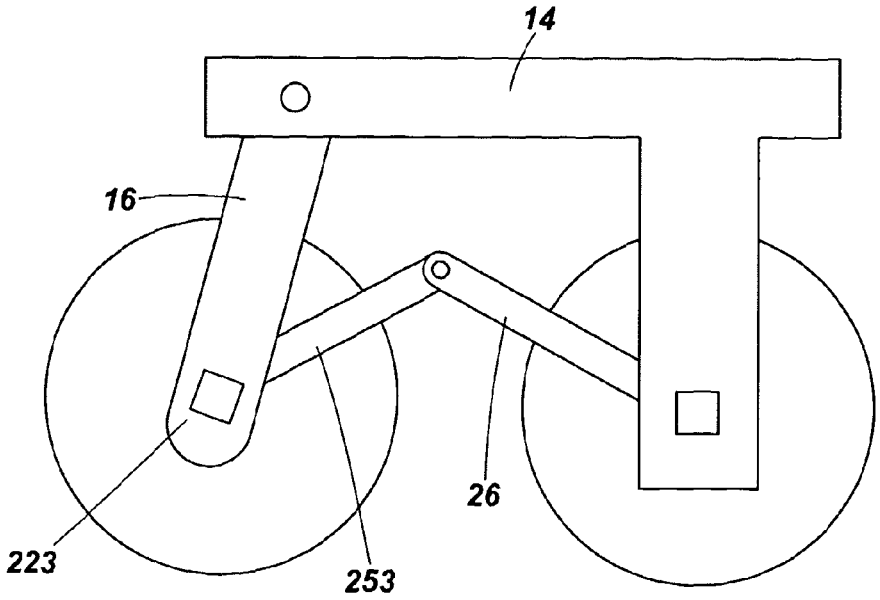
FIG. 6 is the other end view corresponding to FIG. 5.
Figure 7:
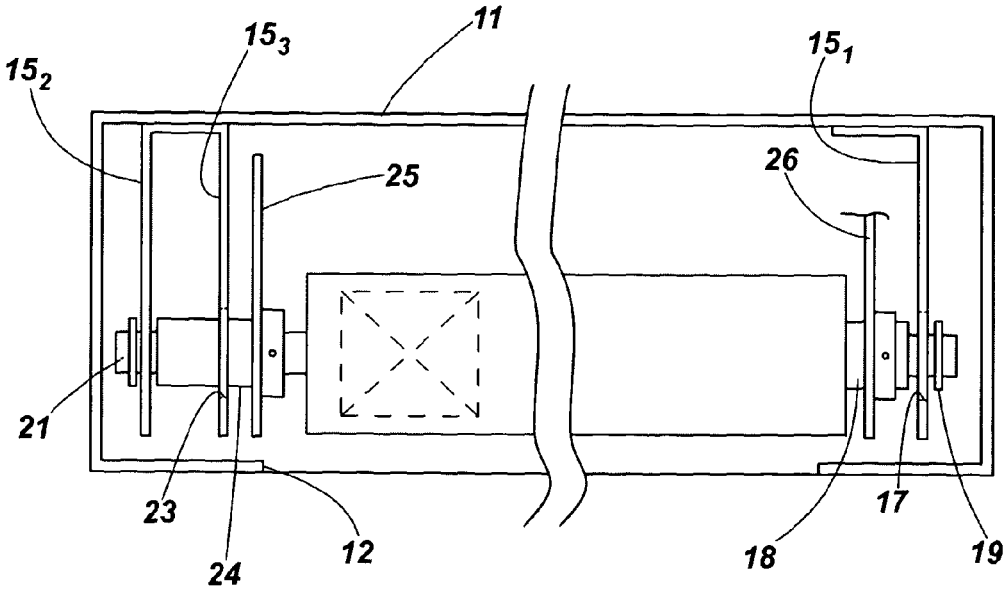
FIG. 7 is a shortened side view o f one of the rollers in the head box.
Figure 8:
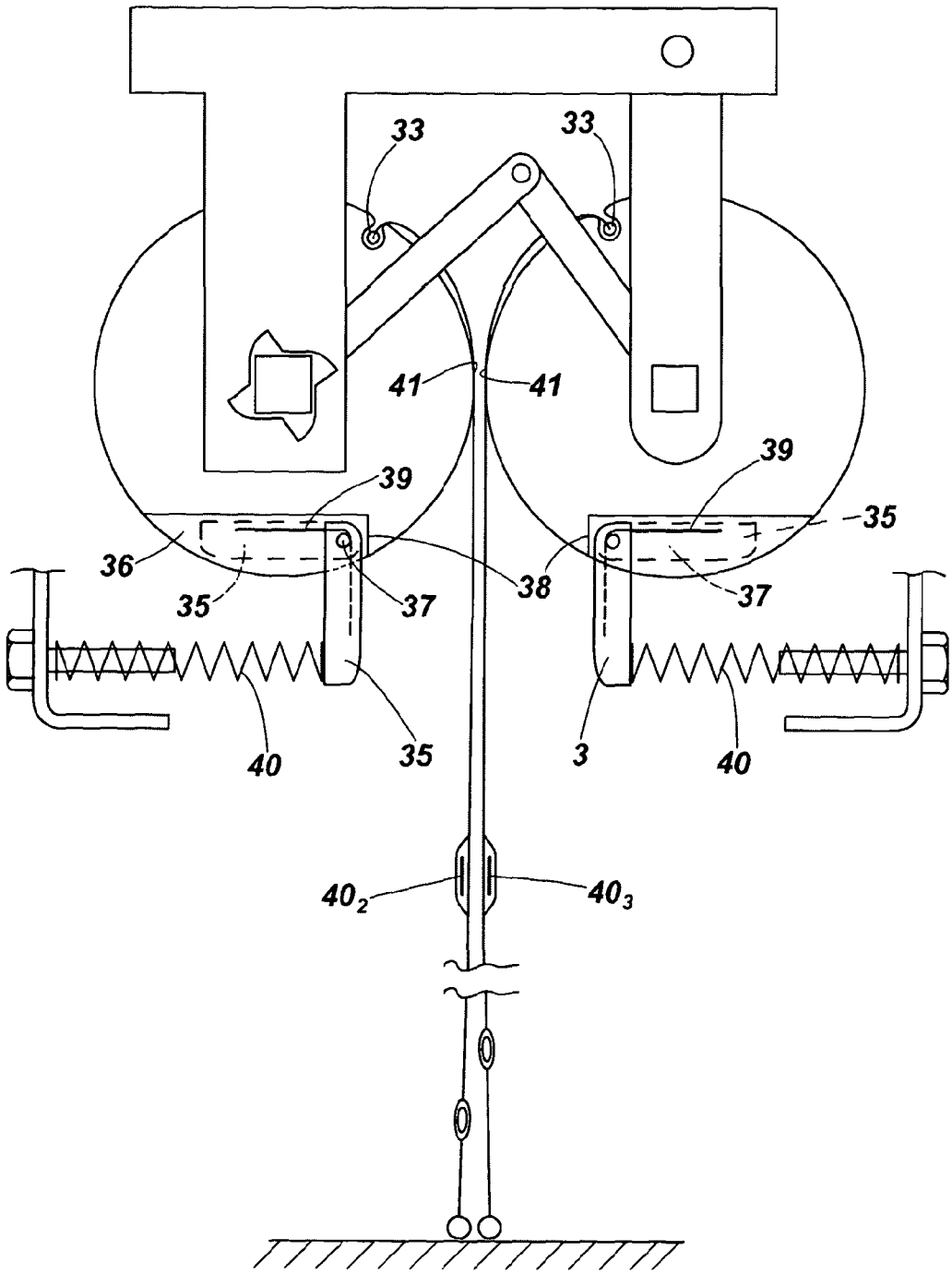
FIG. 8 is a view similar to FIG. 4 showing stops for stopping the rollers with at a desired curtain drop.

With reference to FIGS. 5 & 6, and in particular to FIG. 5 first, which shows the driven end of the roller 2, in steady state, the roller's motor applies a torque equal to the weight W of the curtain portions of the roller 2 applied at the radius R of the roller and works against this torque. For the purposes of considering the steady state forces, the motor and in particular its gearbox can be regarded as applying equal and opposite torque equal to W×R between the roller and the lever arm 25. This torque is reacted as a compression force C in the strut 263 (which is exerting no torque). The support 16 also exerts no torque and supports a tension T comprising the weight of the curtain portions of the roller 3, the weight of the roller 3 (or at least the proportion of these at this end of the roller 3) and the vertical component of the force C in the strut 263. The system finds equilibrium when the horizontal component of the forces in the strut 263 and the support 16 are equal and opposite.

At the opposite end, as shown in FIG. 6, the strut 26 and the lever arm 253 are linked in like manner to the first end the forces and torques are resolved in analogous manner.

It should be noted that the motors will normally stop their drive of the curtain up into the head box when a closure plate at the foot of the curtain reaches the head box and causes their current to rise to a stall current level. This causes a conventional motor control circuit to switch of the motor current and apply a brake current. The motors incorporate brakes not shown, which (as will be known by the skilled reader) normally hold the rollers stationary. It should be noted that the rollers are held braked in their swung apart position. On release of the brakes, the weight of the bottom bar of the curtain and of additional weights in 29 in pockets 30, causes the curtain to deploy downwards.

It will be noted from FIG. 5, that when the curtain is fully wound up there is space between the rollers for the weights 29 in their pockets 30. Where these are provided, they hold the rollers apart. On deployment of the curtain, the weights descend and the rollers approach each other, with the margins abutting until the curtain is fully deployed, at which point they may be separated by the distance D.

Should the rollers continue to rotate, under the weight of the curtain material only, not only will the curtain become slack leading to the possibility of bellying and smoke leakage at the margins, but also the curtain will hang directly from its points 33 of attachment to the rollers. These will rotate until they are at the bottom of the rollers. The distance D will then be unacceptably large. To guard against this, chordal pieces 35, that is pieces defined by a chord and the short circumference between the ends of the chord, are pivoted in slots 36 at each end of the rollers. The pivot points 37 are provided at the one end of the chordal pieces and stops 38 are provided so that the straight sides of the chordal pieces can extend radially outwards of the rollers in equivalent positions at both ends of the rollers. The slots are positioned so as to be covered by wound up curtain material, that is to say that as the first turn of the curtain material approaches the respective chordal members, it causes them to be pivoted inwards into their slots. Equally as they are exposed, they pivot out. Springs 39 are provided to assist this.

Resilient stops are provided in the form of springs 40 to abut the chordal members when they are extending directly downwards below the rollers. This arrangement stops the rollers in a position such that the curtain portions are hanging down directly from their points of minimum separation, defining the distance D. These points 41 are known as the "quarter to" and quarter past" points, referring to the them being at the 3 o'clock and 9 o'clock points of a clock face.

In order to enhance the smoke tightness of the curtain at the margins, they are provided with magnets $40_2$ ,$40_3$ arranged North to South on opposite margins. They hold the margins together and are pulled apart when the curtain is wound up with the rollers parted from each other.

Figure 9:
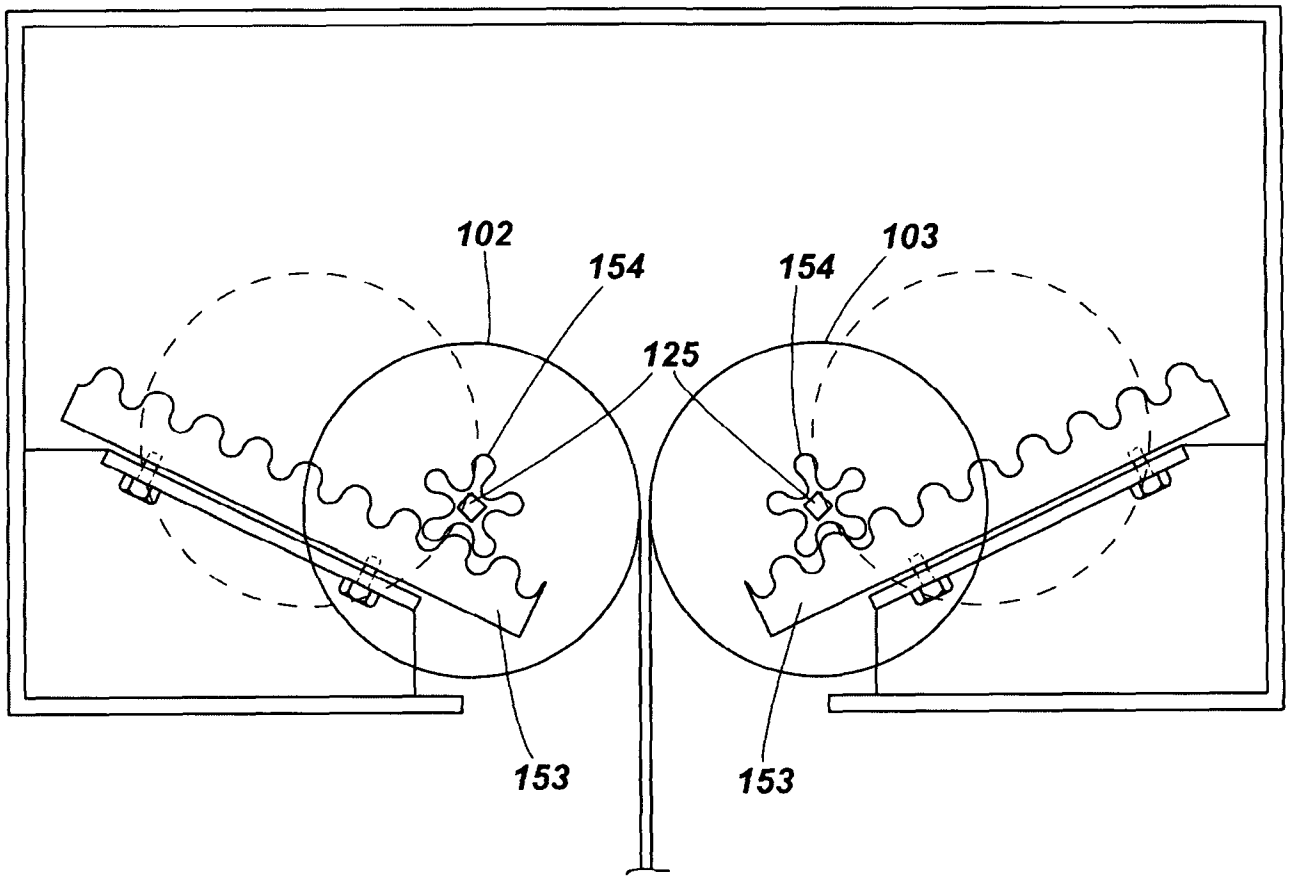
FIG. 9 is a view similar to FIG. 4 of an alternative roller movement mechanism.

Turning now to FIG. 9, an alternative embodiment is shown, where the rollers 102,103 are mounted on racks 153, engaged by pinions 154 fast with the square flat ends 125 of the reaction shafts of the rollers. Four motors are provided in this instance, one at each end of each roller, so that on winding up of the curtain, the reaction torque from the shafts acts via the pinions to drive the blocks up the slides, separating the rollers. Once the curtain is wound up and the motors switched off, the blocks slide back to allow the rollers to abut in analogous manner to that of the previously described embodiment.

Referring to FIGS. 10 to 14, a smoke barrier 201 is deployed from a pair of rollers 202, 203. Wound on the rollers 202, 203 are curtain portions 204, 205 of the curtain 206 of the barrier. In the wound up position shown in FIG. 10, weights 207 at the foot of the curtain are wound onto the rollers. In the deployed position of FIG. 12, the weights just reach the floor F.

The rollers are mounted in a head box 208, which has an opening 209 with a rebate 210. A curtain stabiliser 211 is wound up into the rebate in the FIG. 10 position. It comprises a rectangular frame having longitudinal members 212 on either side of the curtain in use and end members 214 extend past the edges of the curtain to interconnect the long members. Between the long members, in a mouth 215 of the stabiliser, lips 216 extend towards each other and to the lips are fastened piano hinges 217 having their inner flanges 218 free and normally biased to towards each other by springs 219. The arrangement allows the curtain to drop through the stabiliser in the absence of complete alignment.

Figure 14:
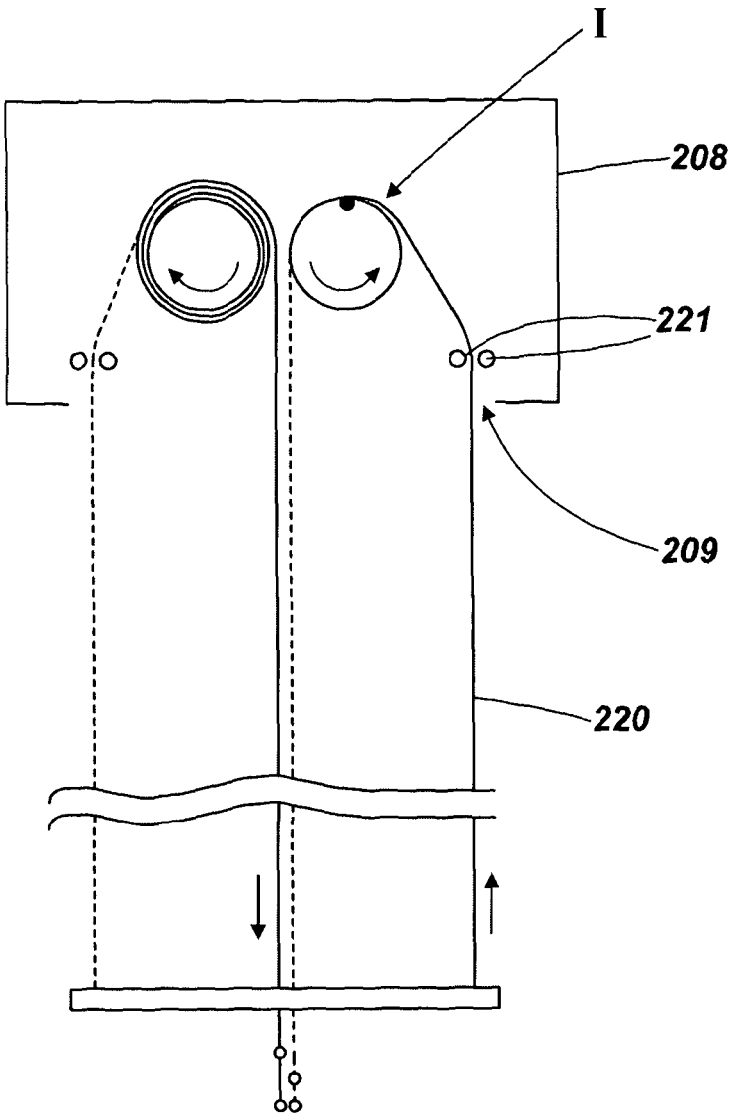
FIG. 14 is a diagrammatic view of the final descent of the curtain and ascent following descent of the stabiliser to its deployed position.
Figure 15:
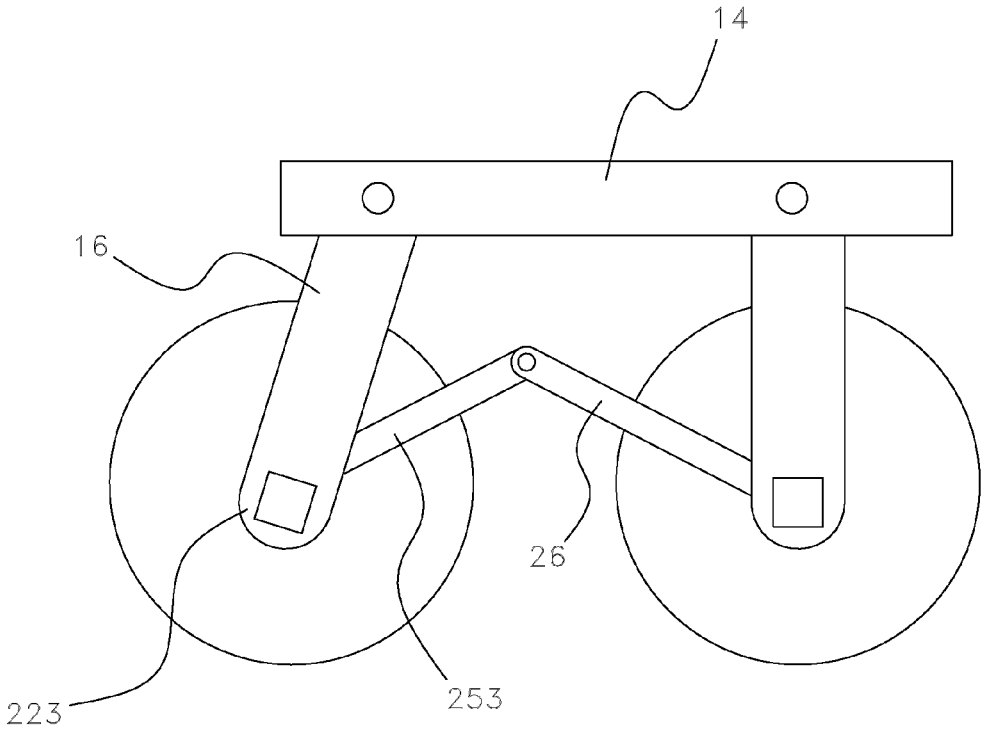
FIG. 15 depicts one embodiment of the present invention having two movable rollers.

The stabiliser is supported by tapes 220 extending from the rollers 202, 203. These are shorter than the drop of the curtain. This results in the tapes being wound back up in the opposite sense during the final deployment of the curtain. In other words at the full extent of the tapes, a position to which the curtain and the stabiliser deploy together, the tapes arrest the stabiliser's descent and then are wound up on the opposite side of the rollers. This is shown in FIG. 14, where an initial winding up of the right hand tape 220 is occurring at arrow I. The reverse happens on rewinding up of the curtain in that on initial winding up, the stabiliser drops to meet the bottom edge of the curtain and then they are wound up together.

In order for the tapes to descend vertically to the stabiliser, they are guided by rollers 221, mounted in the head box.

Figure 10:
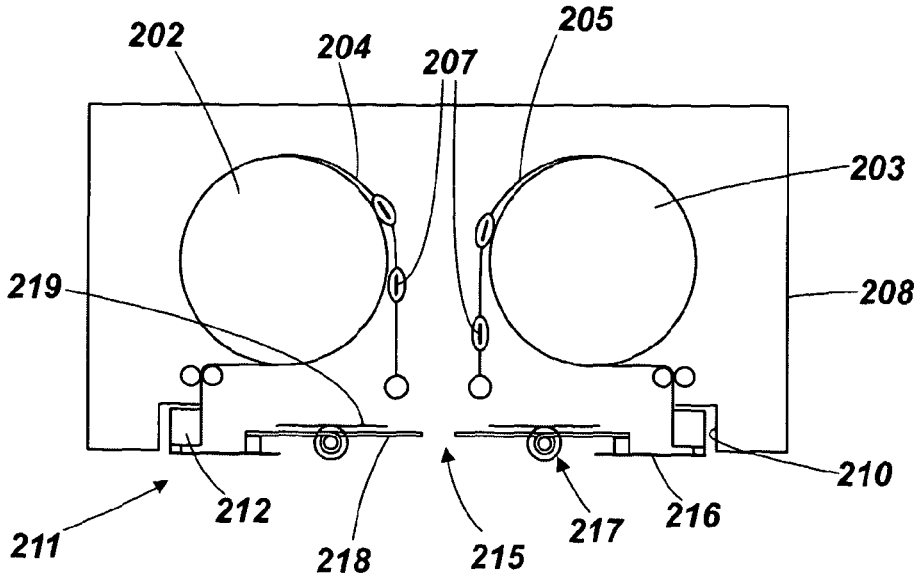
FIG. 10 is an end view of a pair of rollers within a head box of a smoke barrier, with its curtain and a curtain stabiliser withdrawn up to the head box.
Figure 11:
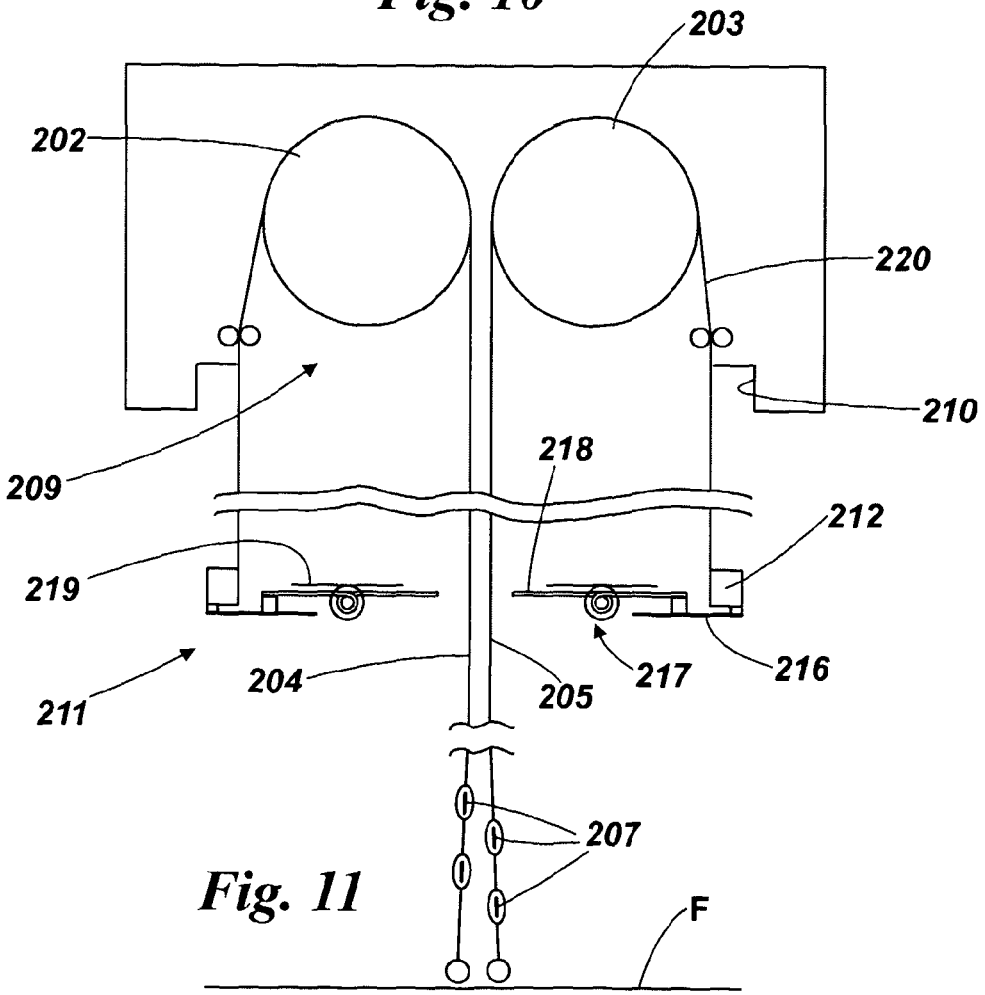
FIG. 11 is a similar end view of with the curtain and curtain stabiliser deployed.
Figure 12:
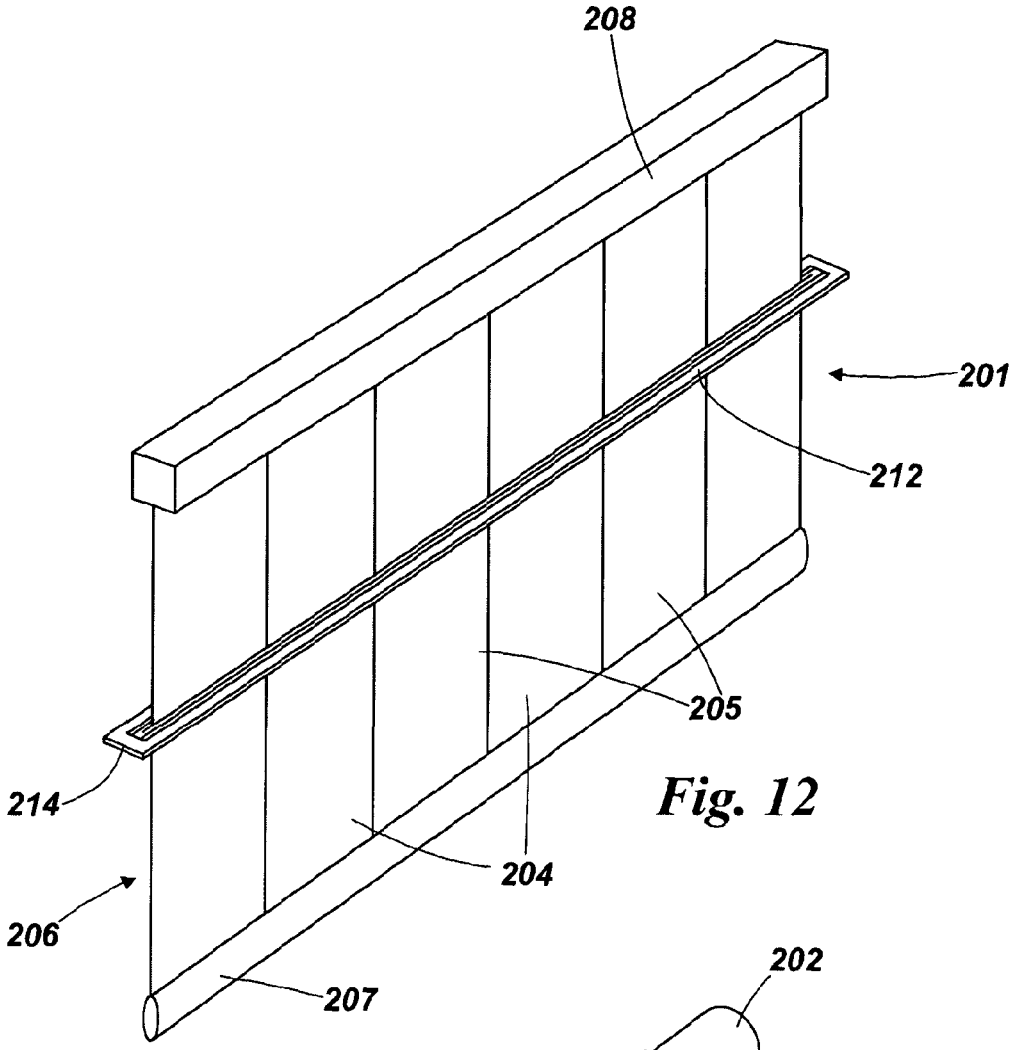
FIG. 12 is a perspective view of the barrier with the curtain and curtain stabiliser deployed.
Figure 13:
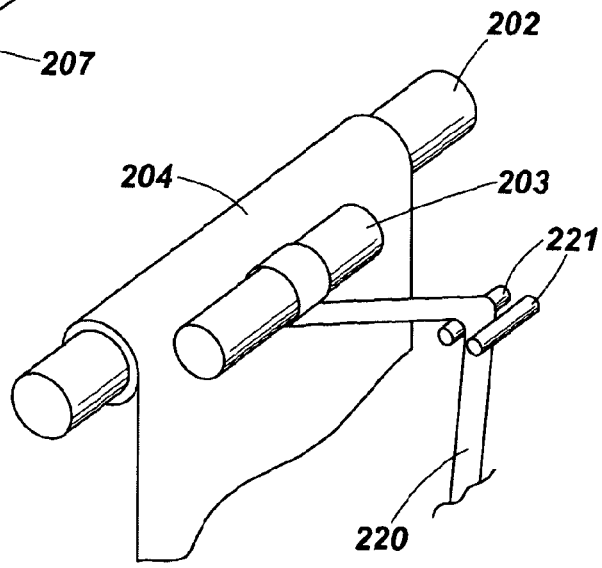
FIG. 13 is a scrap view of a curtain portion depending from its roller and with a stabiliser tape extending from the opposite roller.

It will be apparent from FIG. 10 that when the curtain and stabiliser are up, the stabiliser, including the lips 216 and the hinges 217 close off the opening 209 in the bottom of the head box.

The invention claimed is:

1. A twin roller smoke or fire barrier comprising:

two parallel rollers and a curtain comprised of a plurality of narrow curtain panels rolled on each of the two parallel rollers and arranged along the length of each of the two parallel rollers on alternate rollers with only vertical end margins overlapping opposite each other;

the barrier including:

a separation varying mechanism for varying separation of the two parallel rollers by at least the change in the overall diameter of one of the two parallel rollers and its curtain panels between wound-up and unwound states, the mechanism including:

supports for the two rollers, at least two of the supports being movable supports for at least one of the two parallel rollers to provide movably a supported roller or rollers, the supports supporting at least the ends of the supported rollers, whereby in the unwound state of the curtain, the overlapping vertical end margins abut or at least are separated by a negligible amount at the two parallel rollers.

2. A twin roller smoke or fire barrier as claimed in claim 1, further comprising bearings for journalling the two parallel roller on the supports.

3. A twin roller smoke or fire barrier as claimed in claim 1, wherein the two parallel rollers include internal bearings with non-rotating shafts extending from the two parallel rollers connectable to the supports.

4. A twin roller smoke or fire barrier as claimed in claim 1, wherein one of the two parallel rollers is movable in separation from the other.

5. A twin roller smoke or fire barrier as claimed in claim 1, wherein both of the two parallel rollers are movable in separation from each other.

6. A twin roller smoke or fire barrier as claimed in claim 1, wherein in the separation varying mechanism, the two parallel rollers are each suspended via support links from a common axis above and between them, the rollers being supported at the distal end of the links, the arrangement being such that, under their weight and that of the curtain, the two parallel rollers can swing together with the curtain end margins abutting against each other.

7. A twin roller smoke or fire barrier as claimed in claim 1, wherein in the separation varying mechanism, the two parallel rollers are mounted in support blocks able to slide towards and apart from each other, the blocks being sprung loaded towards each other or mounted in inclined tracks so as to move together under gravity.

8. A twin roller smoke or fire barrier as claimed in claim 7, wherein the mechanism includes a rack and a pinion, the pinion being attached to a motor reaction shaft and in mesh with a rack above it, whereby the motor's torque in lifting the curtain is reacted as a torque tending to move pinion and one of the two parallel rollers away from the other of the two parallel rollers.

9. A twin roller smoke or fire barrier as claimed in claim 1, wherein;

each roller of the two parallel rollers includes a roller rotation motor and gearbox having a reaction shaft a member and the separation varying mechanism includes a member connected to the reaction shaft of a roller rotation motor and gearbox in a manner to cause the mechanism to increase separation of the rollers.

10. A twin roller smoke or fire barrier as claimed in claim 9, wherein the barrier is arranged for gravity-fail-safe unwinding of the curtain and the two parallel rollers are supported in such a manner that they swing together under gravity during unwinding.

11. A twin roller smoke or fire barrier as claimed in claim 9, wherein the said member is additional to the supports.

12. A twin roller smoke or fire barrier as claimed in claim 9, wherein the movable supports for at least one of the rollers are depending links and reaction members are provided in an invert-V, the members being pivoted together at their common end and pivoted to the roller-journalling ends of the supports, with at least one of the reaction members being connected to the reaction shaft of one of the rollers.

13. A twin roller smoke or fire barrier as claimed in claim 12, wherein the supports and/or the invert-V members are ganged together from end to end of the two parallel rollers, whereby the reaction torque from a single motor separates the two parallel rollers.

14. A twin roller smoke or fire barrier as claimed in claim 12, wherein at least one of the two parallel rollers is provided with oppositely rotating motors at both ends, whereby it is moved away from the other roller of the two parallel rollers uniformly from end-to-end.

15. A twin roller smoke or fire barrier as claimed in claim 1, wherein only one roller of the two parallel rollers is movable, with the other being restrained.

16. A twin roller smoke or fire barrier as claimed in claim 1, wherein each curtain panel includes a weighted bottom pocket and space is provided between the two parallel rollers for the weights in their pockets when the curtain is fully wound up.

17. A twin roller smoke or fire barrier as claimed in claim 1, further comprising:

chordal pieces are pivoted in slots at each end of the two parallel rollers and stops arranged to abut the chordal members when they are extending directly downwards below the two parallel rollers the arrangement being such that the two parallel rollers are in a position such that the curtain panels are hanging down directly from their points of minimum separation.

18. A twin roller smoke or fire barrier as claimed in claim 1, including magnets arranged North to South on opposite margins of the curtain panels for enhancing tightness of the curtain.

19. A twin roller smoke or fire barrier as claimed in claim 1, further comprising:

a curtain stabiliser having a pair of members extending laterally of the curtain on either side thereof and means for deploying the curtain stabiliser from an upper position, generally level with a bottom edge of the curtain when rolled up, to a lower level intermediate the deployed height of the curtain, the arrangement being such that in the event of opening of panels of the curtain below the stabiliser, the curtain remains un-disturbed and smoke containing above the stabiliser.

20. A twin roller smoke or fire barrier as claimed in claim 19, wherein the deployment means comprises mechanical inter-connection with one or both of the two parallel rollers for the curtain.

21. A twin roller smoke or fire barrier as claimed in claim 19, wherein the mechanical interconnection is by providing tapes for supporting the curtain stabiliser wound on smaller or differing diameter lengths of at least one of the two parallel rollers, whereby one roller revolution deploys the curtain down the stabiliser.

22. A twin roller smoke or fire barrier as claimed in claim 19, wherein the mechanical interconnection is by providing tapes, the arrangement being such that when their full extent is unwound, continuing turning of the two parallel rollers to fully deploy the curtain results in the stabiliser being wound up again, to a use position.

23. A twin roller smoke or fire barrier as claimed in claim 19, wherein the stabiliser comprises a pair of bars or plates, linked at either end by links passing from one side of the curtain to the other at its edges.

24. A twin roller smoke or fire barrier as claimed in claim 23, wherein the bars or plates can abut the curtain directly, one or other abutting in accordance with pressure across the curtain moving it in one or other direction.

25. A twin roller smoke or fire barrier as claimed in claim 23, further comprising abutting members hinged or otherwise movably connected to the bars or plates with the abutting members normally resting against the curtain, the abutting members being arranged to allow bottom weights of the curtain to be drawn up between them.

* * * * *